US006011351A

United States Patent [19]

Schemm

[11] Patent Number: 6,011,351

[45] Date of Patent: Jan. 4, 2000

[54] UNCAPPED ELECTRIC LUMINAIRE HAVING HOUSING AND LOW-PRESSURE DISCHARGE LAMP CONNECTED VIA ADHESIVE TAPE

[75] Inventor: Ulrich Schemm, Andechs, Germany

[73] Assignee: Patent-Treuhand-Gesellschaft fuer elektrische Gluelampen mbH, Munich, Germany

[21] Appl. No.: 09/009,223

[22] Filed: Jan. 20, 1998

[30] Foreign Application Priority Data

Jan. 20, 1997 [DE] Germany ..... 197 01 796

[51] Int. Cl.[7] ..... H01J 1/62; H01J 63/04; H01J 17/16; H01J 61/30

[52] U.S. Cl. ..... 313/493; 313/17; 313/25; 313/26; 313/318.01; 313/634; 439/611

[58] Field of Search ..... 313/17, 25, 26, 313/318.01, 318.03, 318.05, 318.06, 318.08, 491–93, 573–74, 634–35, 631–32, 238, 247–49, 251, 252, 266; 362/216–17, 220–25, 260, 362, 368; 439/226, 228–29, 235–36, 276, 611, 615

[56] References Cited

U.S. PATENT DOCUMENTS 4,147,947 4/1979 Hoeh ..... 313/493 X
5,697,697 12/1997 Cserteg et al. ..... 362/225
5,751,105 5/1998 Cserteg et al. ..... 313/493
5,772,310 6/1998 Cserteg et al. ..... 313/318.08 X
5,864,202 1/1999 Cserteg et al. ..... 313/318.08

FOREIGN PATENT DOCUMENTS 91 12 691.6 1/1992 Germany .

*Primary Examiner*—Nimeshkumar D. Patel
*Assistant Examiner*—Mack Haynes
*Attorney, Agent, or Firm*—Carlo S. Bessone

[57] ABSTRACT

The invention relates to an electric luminaire having a luminaire housing (10, 11) and at least one low-pressure discharge lamp (12) as well as an operating device for operating the at least one low-pressure discharge lamp (12), the operating device having lamp-side (19*a*) and line-side electric terminals (19*e*, 19*f*) for supplying voltage to the at least one low-pressure discharge lamp (12) and to the operating device. According to the invention, the at least one low-pressure discharge lamp (12) is fastened to the luminaire housing (10) with the aid of an adhesive means (13), preferably by means of a double-sided adhesive tape. Moreover, according to the invention the at least one low-pressure discharge lamp (12) is uncapped and has a plurality of supply leads (14*a*, 14*b*, 14*c*, 14*d*) which project from its discharge vessel and are connected according to the invention in each case to one of the lamp-side electric terminals (19*a*) of the operating device.

12 Claims, 2 Drawing Sheets

Figure 1:
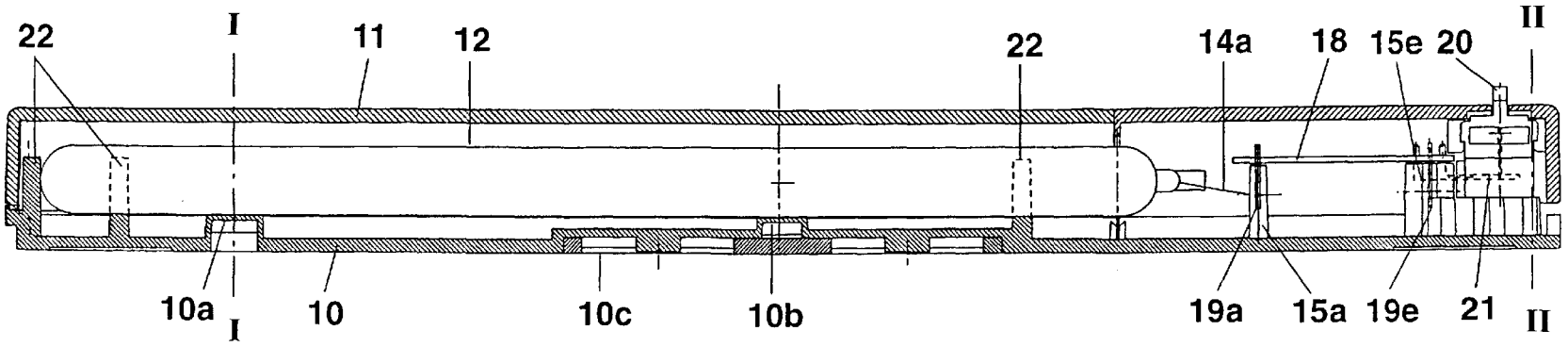

UNCAPPED ELECTRIC LUMINAIRE HAVING HOUSING AND LOW-PRESSURE DISCHARGE LAMP CONNECTED VIA ADHESIVE TAPE

I. PRIOR ART

The invention relates to an electric luminaire. Such an electric luminaire is disclosed, for example, in German Utility Model G 91 12 691.6. This utility model describes a luminaire having a housing, at least one low-pressure discharge lamp arranged in the interior of the housing, and a ballast or operating device for the at least one low-pressure discharge lamp, which ballast or operating device is enclosed by the luminaire housing. The mechanical fastening and electric contacting of the at least one low-pressure discharge lamp are accomplished with the aid of a lamp holder which is constructed in one piece with the luminaire housing.

II. DESCRIPTION OF THE INVENTION

It is the object of the invention to provide an electric luminaire having a luminaire housing and at least one low-pressure discharge lamp as well as an operating device for the at least one low-pressure discharge lamp, which has a design which is as simple as possible and highly cost-effective, and which, in particular, permits as simple a fastening as possible of the at least one low-pressure discharge lamp to the luminaire housing and permits simple electric contact with the at least one low-pressure discharge lamp.

The electric luminaire according to the invention has a luminaire housing, at least one low-pressure discharge lamp and an operating device having lamp-side and line-side electric terminals for operating the at least one low-pressure discharge lamp. According to the invention, the at least one low-pressure discharge lamp is uncapped and its supply leads, which project from the discharge vessel, are respectively connected according to the invention to a lamp-side electric terminal of the operating device. Fastening of the at least one low-pressure discharge lamp to the luminaire housing is performed according to the invention with the aid of an adhesive means. The previously mentioned measures according to the invention permit a comparatively expensive lamp cap and the corresponding lamp holder to be dispensed with in fastening and electrically contacting the at least one low-pressure discharge lamp.

The adhesive means according to the invention advantageously comprises at least one double-sided adhesive tape which produces an adhesive connection between the discharge vessel of the at least one low-pressure discharge lamp and the luminaire housing. In this case, a double-sided adhesive tape whose substrate consists of polyethylene foam and whose adhesive material consists of an acrylate has proved itself in particular. The double-sided adhesive tape advantageously has a thickness of between 0.5 mm and 2 mm. The use of such a double-sided adhesive tape for fastening a lamp permits the housing parts of the advantageously multipartite luminaire housing according to the invention to be connected to one another by means of ultrasonic welding, without the electrodes of the low-pressure discharge lamp being damaged in the process, because the double-sided adhesive tape prevents the ultrasonic vibrations generated during the ultrasonic welding from being transmitted from the housing to the lamp and, in particular, to the sensitive lamp electrodes. Moreover, by comparison, for example, with a silicone adhesive, the double-sided adhesive tape offers the further advantage that no time is lost through the curing of the adhesive material.

The individual components of the operating device are advantageously arranged together with the lamp-side and line-side electric terminals of the operating device on a common mounting plate. The operating device thereby forms a compact unit which can be inserted as a module into the luminaire according to the invention. The operating device is advantageously fastened in the luminaire by means of a mechanical plug-in connection between the mounting plate and the luminaire housing. This mechanical plug-in connection is produced in a particularly advantageous way with the aid of the electric contacts of the operating device, which are advantageously constructed as insulation-piercing contacts. After the power cable has been mounted, when the operating device arranged on the mounting plate is inserted, the line-side insulation-piercing contacts of the operating device cut through the plastic insulation of the power cable strands, and thus produce a reliable electric contact between the operating device and the power lead. The lamp-side insulation-piercing contacts offer the further advantage that the operating device arranged on the mounting plate is already fully contacted electrically by plugging the mounting plate onto the luminaire housing, without this requiring the supply leads, projecting from the discharge vessel, of the at least one low-pressure discharge lamp to be soldered to the lamp-side electric terminals of the operating device. When the operating device is mounted in the luminaire according to the invention, the electric terminals of the operating device, which are designed as insulation-piercing contacts, on the one hand form a mechanical plug-in connection with the luminaire housing, and thus fix the mounting plate with the operating device on the housing. On the other hand, after the at least one low-pressure discharge lamp has been bonded in, when the operating device is inserted into the luminaire these insulation-piercing contacts simultaneously also produce the electric contact between the at least one low-pressure discharge lamp and the operating device as well as between the power cable and the operating device. The switch for switching the luminaire on and off is advantageously connected mechanically and electrically to the operating device by means of a plug-in connection. The electric luminaire according to the invention is realized in a modular design in this way.

III. DESCRIPTION OF THE PREFERRED EXEMPLARY AMBODIMENT

Figure 2:
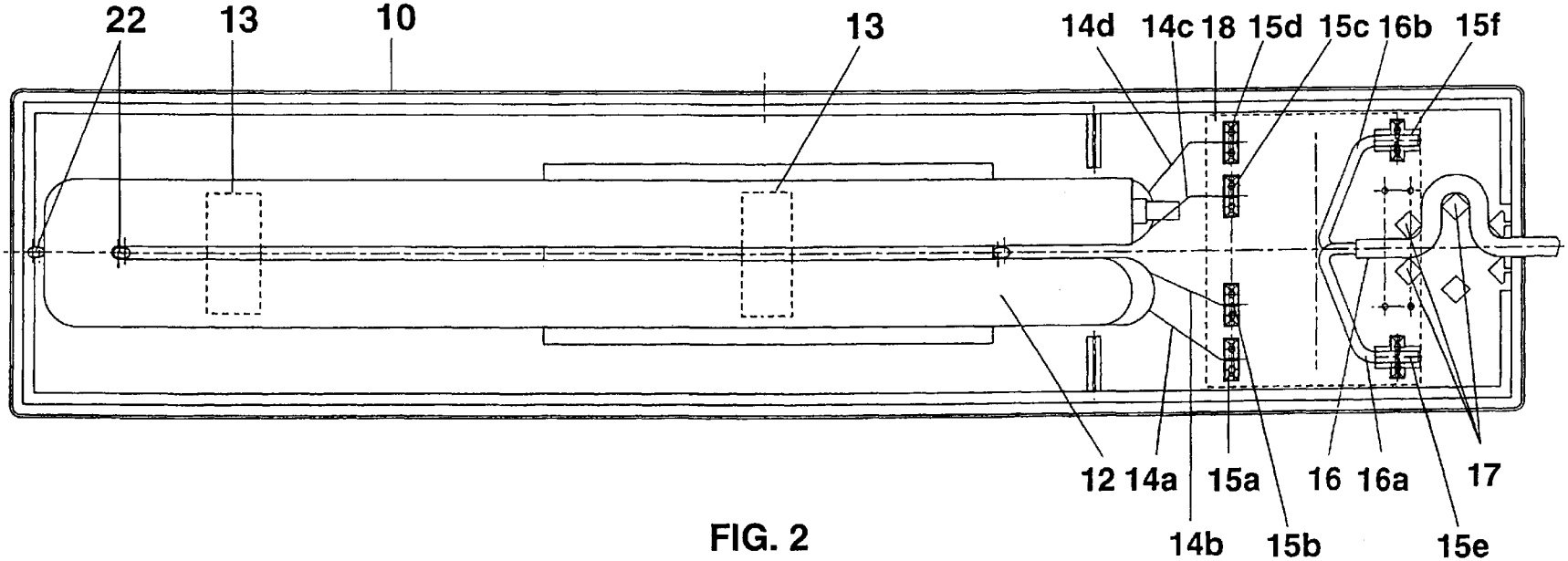
Figure 3:
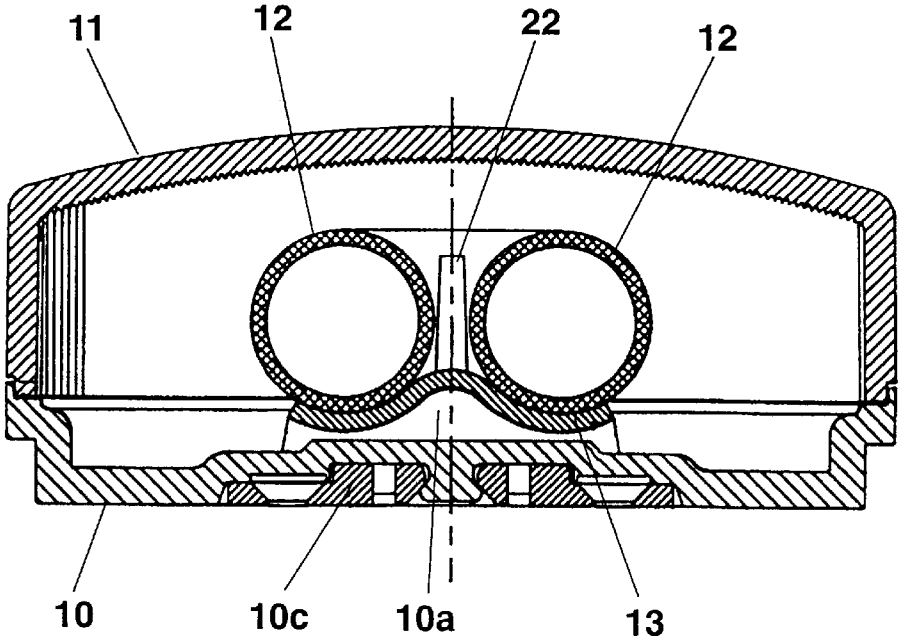
Figure 4:
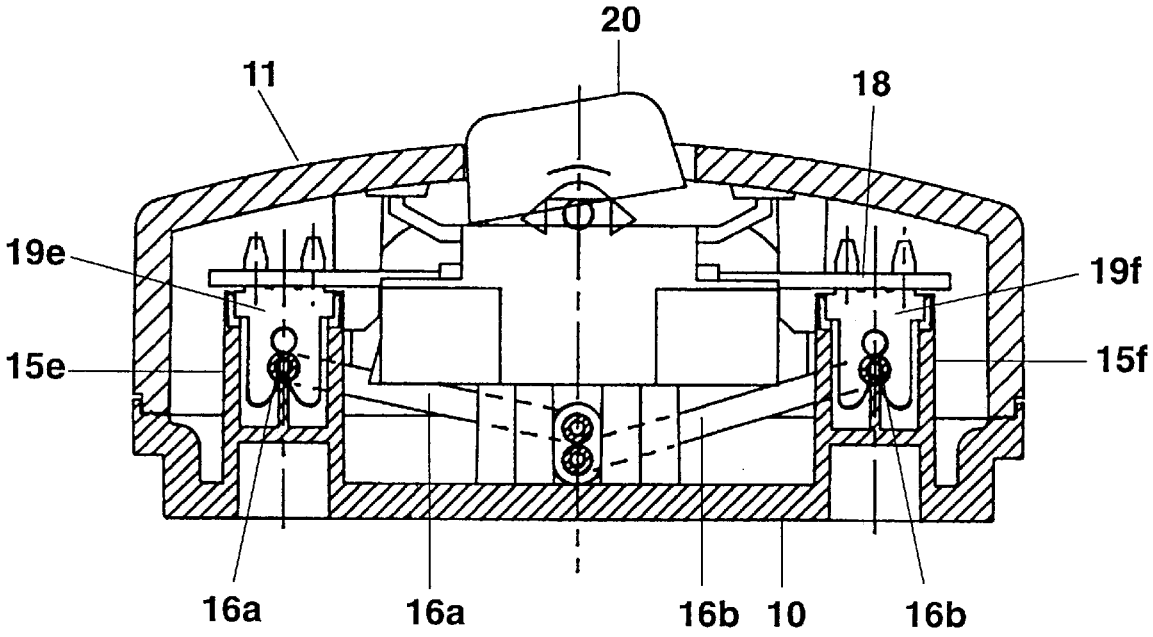

The invention is explained in more detail below with the aid of a preferred exemplary embodiment. In the drawing:

FIG. 1 shows a longitudinal section through the preferred exemplary embodiment of the electric luminaire according to the invention, FIG. 2 shows a top view of the preferred exemplary embodiment of the electric luminaire according to the invention, without the top part, FIG. 3 shows a cross-section through the preferred exemplary embodiment of the electric luminaire according to the invention, along the plane of section I—I, and FIG. 4 shows a cross-section through the preferred exemplary embodiment of the electric luminaire according to the invention, along the plane of section II—II.

The preferred exemplary embodiment of the electric luminaire according to the invention has a bipartite, essentially cuboidal plastic housing which is formed from a bottom part 10 and a top part 11 which are connected to one another by ultrasonic welding. The top part 11 and bottom part 10 of the housing are constructed from injection-moulded plastic parts. Arranged in the interior of the luminaire housing 10, 11 is an uncapped low-pressure discharge lamp having a U-shaped discharge vessel 12. The discharge vessel 12 rests on two supports 10*a*, 10*b* integrally formed on the bottom part 10 of the housing, and is respectively bonded onto these supports 10*a*, 10*b* by means of a double-sided adhesive tape 13. The substrate of the double-sided adhesive tapes 13 used here consists of polyethylene foam, and the adhesive material consists of acrylate. The adhesive tapes 13 have a thickness of approximately 1.2 mm.

The top part 11 of the housing is transparent in the region of the discharge vessel 12. Projecting in each case from the free, sealed ends of the two U-limbs of the U-shaped discharge vessel 12 are two supply leads 14*a*, 14*b*, 14*c*, 14*d* which are fixed in each case in a holding device 15*a*, 15*b*, 15*c*, 15*d* which is provided with slots and constructed in one piece with the bottom part 10 of the housing. The bottom part 10 of the housing also has two further holding devices 15*e*, 15*f*, provided with slots. A strand 16*a*, 16*b*of the power cable 16, which likewise belongs to the luminaire, is fixed in each case in each of these holding devices 15*e*, 15*f*. The power cable 16 serves to supply the luminaire with line voltage, and is threaded through an opening in the luminaire housing via a plurality of guide webs 17 constructed as a strain relief device. The luminaire further has an electronic operating device (not illustrated) for operating the low-pressure discharge lamp 12, whose individual components (not illustrated) are arranged on a rectangular mounting plate 18. The electronic operating device is equipped with four lamp-side 19*a* and two line-side electric terminals 19*e*, 19*f*, which are likewise arranged on the mounting plate 18. All these electric terminals 19*a*, 19*e*, 19*f* are constructed as insulation-piercing contacts. When the operating device arranged on the mounting plate 18 is inserted into the luminaire, said insulation-piercing contacts engage in the slots of the holding devices 15*a*, 15*b*, 15*c*, 15*d*, 15*e*, 15*f*, and form a mechanical plug-in connection with the latter and in this case produce the electric contact between the operating device and the corresponding supply leads 14*a*, 14*b*, 14*c*, 14*d*, 14*e*, 14*f*, arranged in these holding devices 15*a*, 15*b*, 15*c*, 15*d*, 15*e*, 15*f*, and the power cable strands 16*a*, 16*b*. The switch 20 for switching the luminaire on and off is likewise plugged on the mounting plate 18 by means of a plug-in connection 21 and connected in an electrically conducting fashion to the operating device. The bottom part 10 of the luminaire housing is also equipped with three integrally formed guide webs 22, which serve to install the low-pressure discharge lamp 12 in the correct position. Moreover, on its underside the bottom part 10 of the housing is provided with a plurality of guide rails 10*c* for mounting the luminaire on a wall.

The invention is not restricted to the preferred exemplary embodiment described in detail above. Thus, for example, it lies within the discretion and ability of the person skilled in the art also to equip the luminaire according to the invention with a plurality of low-pressure discharge lamps. Furthermore, the lamp-side electric terminals of the operating device need not necessarily be constructed as insulation-piercing contacts. It is also possible instead of this for all or some of the supply leads projecting from the discharge vessel of the at least one low-pressure discharge lamp to be soldered to the appropriate electric terminal of the operating device.

What is claimed is:

1. An electric luminaire having a luminaire housing (10, 11) and at least one low-pressure discharge lamp (12) as well as an operating device for operating the at least one low-pressure discharge lamp (12), the operating device having lamp-side (19*a*) and line-side electric terminals (19*e*, 19*f*) for supplying voltage to the at least one low-pressure discharge lamp (12) and to the operating device, characterized in that the at least one low-pressure discharge lamp (12) is fastened to the luminaire housing (10, 11) with the aid of an adhesive means (13) and the at least one low-pressure discharge lamp (12) is uncapped and has a plurality of supply leads (14*a*, 14*b*, 14*c*, 14*d*) which project from its discharge vessel (12) and are respectively connected to one of the lamp-side electric terminals (19*a*) of the operating device.

2. The electric luminaire according to claim 1, characterized in that the adhesive means comprise at least one double-sided adhesive tape (13) which produces an adhesive connection between the luminaire housing (10, 11) and the discharge vessel (12) of the at least one low-pressure discharge lamp.

3. The electric luminaire according to claim 2, characterized in that the substrate of the at least one double-sided adhesive tape (13) consists of polyethylene foam.

4. The electric luminaire according to claim 2, characterized in that the adhesive material of the at least one double-sided adhesive tape (13) consists of acrylate.

5. The electric luminaire according to claim 2, characterized in that the thickness of the at least one double-sided adhesive tape (13) is between 0.5 mm and 2 mm.

6. The electric luminaire according to claim 1, characterized in that the components of the operating device are arranged together with the electric terminals (19*a*, 19*e*, 19*f*) of the operating device on a common mounting plate (18).

7. The electric luminaire according to claim 6, characterized in that the mounting plate (18) is mechanically fastened to the luminaire housing (10, 11) by means of a plug-in connection.

8. The electric luminaire according to claim 1, characterized in that at least the line-side electric terminals (19*e*, 19*f*) are constructed as insulation-piercing contacts.

9. The electric luminaire according to claim 1, characterized in that the lamp-side electric terminals (19*a*) are constructed as insulation-piercing contacts.

10. The electric luminaire according to claim 8, characterized in that the electric terminals (19*a*, 19*e*, l9*f*), designed as insulation-piercing contacts, of the operating device form a mechanical plug-in connection (15*a*, 15*b*, 15*c*, 15*d*, 15*e*, 15*f*) with the luminaire housing (10, 11).

11. The electric luminaire according to claim 1, characterized in that the luminaire has a switch (20) for switching on and off, which is mechanically and electrically connected to the operating device by means of a plug-in connection (21).

12. The electric luminaire according to claim 1, characterized in that the luminaire housing has at least two housing parts (10, 11) connected to one another by means of ultrasonic welding.

* * * * *